US009691324B2

(12) United States Patent
Choe

(10) Patent No.: US 9,691,324 B2
(45) Date of Patent: Jun. 27, 2017

(54) COMPENSATION DATA CALCULATION METHOD FOR COMPENSATING DIGITAL VIDEO DATA AND ORGANIC LIGHT EMITTING DISPLAY INCLUDING LOOK-UP TABLE GENERATED USING THE SAME

(71) Applicant: SAMSUNG DISPLAY CO., LTD., Yongin, Gyeonggi-Do (KR)

(72) Inventor: Won-Jun Choe, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 76 days.

(21) Appl. No.: 14/639,497

(22) Filed: Mar. 5, 2015

(65) Prior Publication Data

US 2015/0262524 A1 Sep. 17, 2015

(30) Foreign Application Priority Data

Mar. 17, 2014 (KR) ..... 10-2014-0030806

(51) Int. Cl.
*G09G 3/3233* (2016.01)

(52) U.S. Cl.
CPC ... *G09G 3/3233* (2013.01); *G09G 2320/0285* (2013.01); *G09G 2360/148* (2013.01)

(58) Field of Classification Search
CPC ..... G09G 3/3225; G09G 3/342; G09G 3/3607
See application file for complete search history.

(56) References Cited

U.S. PATENT DOCUMENTS

2002/0145584 A1* 10/2002 Waterman ..... G09G 3/2011 345/98
2002/0190999 A1 12/2002 Lee
2010/0053137 A1* 3/2010 Park ..... G09G 3/3225 345/211
2011/0222768 A1 9/2011 Galic et al.
2012/0194536 A1* 8/2012 Pyo ..... G09G 3/342 345/589
2012/0236041 A1 9/2012 Oh
2013/0286055 A1 10/2013 Nathan et al.
2015/0255025 A1* 9/2015 Chen ..... G09G 3/3607 345/589

FOREIGN PATENT DOCUMENTS

KR 2002-0095350 A 12/2002
KR 10-2012-0104783 A 9/2012
KR 10-2013-0016213 A 2/2013

* cited by examiner

*Primary Examiner* — Gerald Johnson
(74) *Attorney, Agent, or Firm* — Lewis Roca Rothgerber Christie LLP

(57) ABSTRACT

A method for calculating compensation data includes, a first luminance value that is calculated by supplying a first gray scale voltage to pixels and measuring a luminance. A second luminance value is calculated by supplying a second gray scale voltage to the pixels and measuring a luminance. Compensation coefficients are calculated using the first and second gray scale voltages and the first and second luminance values. Compensation data are calculated based on the compensation coefficients.

14 Claims, 3 Drawing Sheets

COMPENSATION DATA CALCULATION METHOD FOR COMPENSATING DIGITAL VIDEO DATA AND ORGANIC LIGHT EMITTING DISPLAY INCLUDING LOOK-UP TABLE GENERATED USING THE SAME

CROSS-REFERENCE TO RELATED APPLICATION

This application claims priority to and the benefit of Korean Patent Application No. 10-2014-0030806, filed on Mar. 17, 2014, in the Korean Intellectual Property Office, the entire contents of which are incorporated herein by reference in their entirety.

BACKGROUND

1. Field

An aspect of the present invention relates to a compensation data calculation method for compensating digital video data and an organic light emitting display using the same.

2. Description of the Related Art

Recently, there have been developed various types of flat panel displays having recued weight and volume in comparison to cathode ray tubes. The flat panel displays include a liquid crystal display, a field emission display, a plasma display panel, an organic light emitting display, and the like.

Among these flat panel displays, the organic light emitting display displays images using organic light emitting diodes that emit light through recombination of electrons and holes. The organic light emitting display has a fast response speed while being driven with low power consumption.

The organic light emitting display includes a data driver configured to supply data voltages to data lines, a scan driver configured to supply scan signals to scan lines, and pixels respectively located at areas defined by scan lines and data lines. The pixel controls current supplied to an organic light emitting diode, based on a data voltage supplied to a gate electrode of a driving transistor.

Due to a fabrication process variation of the organic light emitting display, the luminance of light that the pixels in a display panel emit may be different from an originally intended luminance. In order to solve such a problem, there has been proposed a method in which after the fabrication process of an organic light emitting display is completed, a luminance of light that pixels emit is measured by supplying a predetermined gray scale voltage to the pixels, and compensation data are calculated based on the measured luminance. In this case, the organic light emitting display stores the calculated compensation data in a look-up table, compensates digital video data using the compensation data, and then supplies the compensated digital video data to the pixels. Accordingly, it is possible to solve the problem in that the luminance of light that the pixels emit is different from the originally intended luminance.

Meanwhile, in a related art for compensation data calculation method, a process of measuring a luminance of light that pixels emit by supplying a predetermined gray scale voltage to the pixels is repeated several times in order to increase the accuracy of compensation data. In this case, the calculation time of the compensation data, however, increases.

SUMMARY

Embodiments of the present invention provide a compensation data calculation method for compensating digital video data and an organic light emitting display including a look-up table generated using the same, which can reduce the calculation time of compensation data.

One aspect of the present invention includes, a method for calculating compensation data, the method including determining a first luminance value by supplying a first gray scale voltage to pixels and measuring a luminance, determining a second luminance value by supplying a second gray scale voltage to the pixels and measuring a luminance, calculating compensation coefficients utilizing the first and second gray scale voltages and the first and second luminance values, and calculating compensation data based on the compensation coefficients.

The method of calculating the compensation coefficients may include using equations including the first and second gray scale voltages and the first and second luminance values.

When the first gray scale voltage is V1, the second gray scale voltage is V2, the first luminance value is L1, the second luminance value is L2, a first compensation coefficient of the compensation coefficients is α, and a second compensation coefficient of the compensation coefficients is β, the first and second compensation coefficients may be calculated by $$\alpha = \frac{L1}{(V1-\beta)^2},$$

$$\beta = \frac{(\Gamma \times V1 - V2)}{\Gamma - 1}$$

and $$\Gamma = \sqrt{\frac{L2}{L1}}.$$

The method may further include determining a third luminance value by supplying a third gray scale voltage to the pixels and measuring the luminance, wherein the calculating the compensation coefficients method may further include utilizing the third gray scale voltage and the third luminance value.

The calculating the compensation coefficients may include utilizing equations including the first to third gray scale voltages and the first to third luminance values.

In the calculating the compensation coefficients, when the first gray scale voltage is V1, the second gray scale voltage is V2, the third gray scale voltage is V3, the first luminance value is L1, the second luminance value is L2, the third luminance value is L3, a first compensation coefficient of the compensation coefficients is α, a second compensation coefficient of the compensation coefficients is β, and a third compensation coefficient of the compensation coefficients is γ, the first to third compensation coefficients are calculated by $$\alpha = \frac{L3 - L2}{(V3 + V2 - \beta) \times (V3 - V2)},$$

$$\beta = \frac{\Gamma \times (V1 + V2) - (V2 + V3)}{2(\Gamma - 1)},$$

$$\gamma = L1 - \alpha \times (V1 - \beta)^2,$$

and $$\Gamma = \sqrt{\frac{L2 - L1}{L3 - L2}}.$$

A difference between the third and second gray scale voltages is substantially equal to the difference between the second and first gray scale voltages.

Another aspect of the present invention includes, an organic light emitting display, including: a display panel including data lines, scan lines, and pixels coupled to the data lines and the scan lines, a scan driver configured to supply scan signals to the scan lines, a data driver configured to convert digital video data into data voltages, and to supply the data voltages to the data lines, in synchronization with the scan signals, a look-up table configured to store compensation data for compensating the digital video data; and a digital data compensator configured to compensate the digital video data utilizing the compensation data, wherein a first luminance value is determined by supplying a first gray scale voltage to the pixels and measuring a luminance, a second luminance value is determined by supplying a second gray scale voltage to the pixels and measuring a luminance, compensation coefficients are calculated utilizing the first and second gray scale voltages and the first and second luminance values, and the compensation data are calculated utilizing the compensation coefficients.

The compensation coefficients may be calculated using equations including the first and second gray scale voltages and the first and second luminance values.

When the first gray scale voltage is V1, the second gray scale voltage is V2, the first luminance value is L1, the second luminance value is L2, a first compensation coefficient of the compensation coefficients is α, and a second compensation coefficient of the compensation coefficients is β, the first and second compensation coefficients may be calculated by $$\alpha = \frac{L1}{(V1-\beta)^2},$$

$$\beta = \frac{(\Gamma \times V1 - V2)}{\Gamma - 1}$$

and $$\Gamma = \sqrt{\frac{L2}{L1}}.$$

A third luminance value may be determined by supplying a third gray scale voltage to the pixels and measuring a luminance, compensation coefficients may be calculated using the third gray scale voltage and the third luminance value, and the compensation data may be calculated based on the compensation coefficients.

The compensation coefficients may be calculated using equations including the first to third gray scale voltages and the first to third luminance values.

When the first gray scale voltage is V1, the second gray scale voltage is V2, the third gray scale voltage is V3, the first luminance value is L1, the second luminance value is L2, the third luminance value is L3, a first compensation coefficient of the compensation coefficients is α, a second compensation coefficient of the compensation coefficients is β, and a third compensation coefficient of the compensation coefficients is γ, the first to third compensation coefficients may be calculated by $$\alpha = \frac{L3 - L2}{(V3 + V2 - \beta) \times (V3 - V2)},$$

$$\beta = \frac{\Gamma \times (V1 + V2) - (V2 + V3)}{2(\Gamma - 1)},$$

-continued $$\gamma = L1 - \alpha \times (V1 - \beta)^2,$$

and $$\Gamma = \sqrt{\frac{L2 - L1}{L3 - L2}}.$$

A difference between the third and second gray scale voltages may be substantially equal to the difference between the second and first gray scale voltages.

BRIEF DESCRIPTION OF THE DRAWINGS

Example embodiments will now be described more fully hereinafter with reference to the accompanying drawings; however, they may be embodied in different forms and should not be construed as being limited to the embodiments set forth herein. Rather, these embodiments are provided so that this disclosure will be thorough and complete, and will fully convey the scope of the example embodiments to those skilled in the art.

In the drawings, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
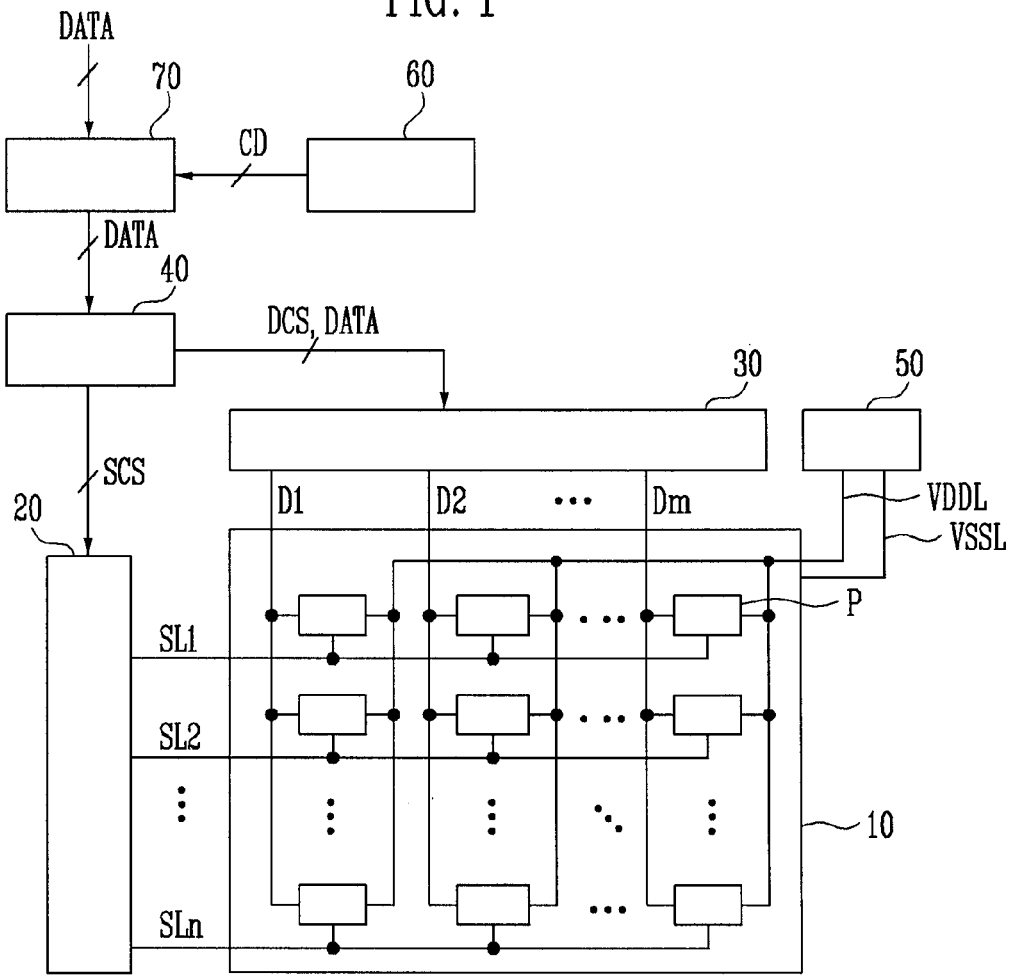
FIG. 1 is a block diagram illustrating an organic light emitting display according to an embodiment of the present invention.

Hereinafter, certain example embodiments according to the present invention will be described with reference to the accompanying drawings. Here, when a first element is described as being coupled or connected to a second element, the first element may be directly coupled or connected to the second element, or may be indirectly coupled or connected to the second element via a third element. Further, some of the elements that are not essential to the complete understanding of the invention may be omitted for clarity. Also, like reference numerals refer to like elements throughout.

FIG. 1 is a block diagram illustrating an organic light emitting display according to an embodiment of the present invention.

Referring to FIG. 1, the organic light emitting display (e.g., organic light emitting diode (OLED) display) according to this embodiment includes a display panel 10, a scan driver 20, a data driver 30, a timing controller 40, a power supply source 50, a look-up table 60, a digital data compensator 70, and the like.

Data lines D1 to Dm (m is a positive integer of 2 or more) and scan lines SL1 to SLn (n is a positive integer of 2 or more) are formed to cross each other in the display panel 10. Pixels P arranged in a matrix form at crossing regions of the data lines D1 to Dm and the scan lines SL1 to SLn (e.g., at or near the areas where the data lines and scan lines cross) are formed in the display panel 10.

Figure 2:
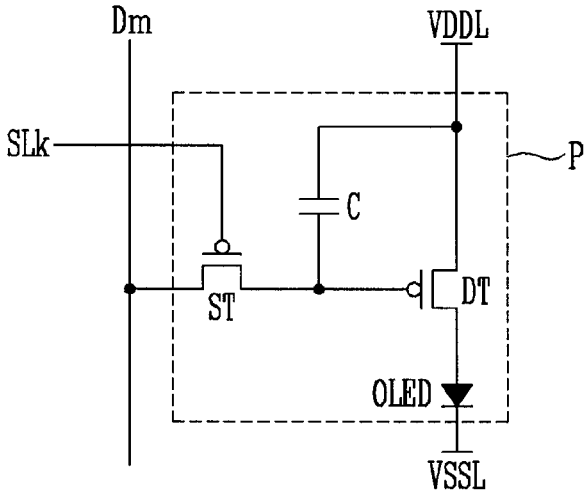
FIG. 2 is an equivalent circuit diagram illustrating an example of a pixel of FIG. 1.

The pixel P, as shown in FIG. 2, may be coupled to a k-th (k is a positive integer satisfying $1 \leq k \leq n$) scan line, a j-th (j is a positive integer satisfying $1 \leq j \leq m$) data line, a first power voltage line VDDL and a second power voltage line VSSL. Referring to FIG. 2, the pixel P may include a driving transistor DT, an organic light emitting diode OLED, a scan transistor ST, a capacitor C, and the like.

The driving transistor DT is formed between the organic light emitting diode OLED and the first power voltage line VDDL, and controls the amount of current flowing through the organic light emitting diode OLED. For example, drain-source current flowing in a channel of the driving transistor DT is changed depending on a data voltage supplied to a control electrode of the driving transistor DT, and hence the amount of the current flowing through the organic light emitting diode OLED may be controlled by controlling the data voltage supplied to the control electrode of the driving transistor DT. The control electrode of the driving transistor DT is coupled to a second electrode of the scan transistor ST, and a first electrode of the driving transistor DT is coupled to the first power voltage line VDDL. A second electrode of the driving transistor DT is coupled to an anode electrode of the organic light emitting diode OLED.

The organic light emitting diode OLED emits light, corresponding to the drain-source current of the driving transistor DT. The anode electrode of the organic light emitting diode OLED is coupled to the second electrode of the driving transistor DT, and a cathode electrode of the organic light emitting diode OLED is coupled to the second power voltage line VSSL.

The scan transistor ST is coupled between the control electrode of the driving transistor DT and the j-th data line Dj. The scan transistor ST is turned on by a scan signal of the k-th scan line SLk, to supply a data voltage of the j-th data line Dj to the control electrode of the driving transistor DT. A control electrode of the scan transistor ST is coupled to the k-th scan line SLk, and a first electrode of the scan transistor ST is coupled to the j-th data line Dj. The second electrode of the scan transistor ST is coupled to the control electrode of the driving transistor DT.

The capacitor C is formed between the control electrode of the driving transistor DT and the first power voltage line VDDL. The capacitor C maintains the data voltage supplied to the control electrode of the driving transistor DT during a predetermined (or set) period.

The driving transistor DT and the scan transistor ST, as shown in FIG. 2, may be formed as P-type thin film transistors. In this case, the control electrode of each of the driving transistor DT and the scan transistor ST may be a gate electrode, and the first electrode of each of the driving transistor DT and the scan transistor ST may be a source or drain electrode. The second electrode of each of the driving transistor DT and the scan transistor ST may be an electrode different from the first electrode. For example, if the first electrode is a source electrode, the second electrode may be a drain electrode, and vice versa. A semiconductor layer of each of the driving transistor DT and the scan transistor ST may be formed of polysilicon, but the present invention is not limited thereto. That is, the semiconductor layer of each of the driving transistor DT and the scan transistor ST may be formed of, for example, any one of a-Si and oxide semiconductor, for example, an oxide semiconductor.

The pixel P may further include a compensation circuit for compensating for a threshold voltage of the driving transistor DT. The compensation circuit may include at least one transistor. The compensation circuit senses a threshold voltage of the driving transistor DT and reflects (e.g., applies) the sensed threshold voltage to the control electrode of the driving transistor DT, so that the drain-source current Ids of the driving transistor DT does not depend on the threshold voltage Vth of the driving transistor DT.

The scan driver 20 supplies scan signals to the scan lines SL1 to SLn, in response to a scan timing control signal SCS. The scan driver 20 may include at least one scan drive integrated circuit (IC). The scan drive IC is mounted on a tape carrier package (TCP), and may be bonded to a lower substrate of the display panel 10 through a tape automated bonding process. Alternatively, the gate drive ICs included in the scan driver 20 may be bonded to the lower substrate of the display panel 10 through a chip on glass (COG) process. Alternatively, the scan drive IC included in the scan driver 20 may be directly formed together with a pixel array PA on the lower substrate of the display panel 10 through a gate driver in panel (GIP) process.

The data driver 30 includes at least one source drive IC. The source drive IC receives digital video data DATA input from the timing controller 40. The source drive IC converts the digital video data DATA into data voltages, in response to a source timing control signal DCS from the timing controller 40. The source drive IC supplies data voltages to the data lines D1 to Dm, in synchronization with each scan signal. Accordingly, the data voltages are supplied to pixels P to which the scan signal is supplied.

The timing controller 40 receives the digital video data DATA input from the digital data compensator 70 through an interface such as a low voltage differential signaling (LVDS) interface or a transition minimized differential signaling (TMDS) interface. The timing controller 40 receives timing signals including a vertical sync signal, a horizontal sync signal, a data enable signal, a dot clock, and the like. The timing controller 40 generates timing control signals for controlling operation timings of the data driver 20 and the scan driver 30, based on the timing signals. The timing control signals include the scan timing control signal SCS for controlling an operation timing of the scan driver 30, and the data timing control signal DCS for controlling an operation timing of the data driver 20. The timing controller 40 outputs the scan timing control signal SCS to the scan driver 30, and outputs the data timing control signal DCS and the digital video data DATA to the data driver 20.

The power supply source 50 supplies a first power voltage to each pixel P of the display panel 10 through a first power voltage line VDDL, and supplies a second power voltage to each pixel P of the display panel 10 through a second power voltage line VSSL. The first power voltage may be set as a high-potential voltage, and the second power voltage may be set as a low-potential voltage. That is, the first power voltage may have a relatively higher voltage level with respect to the second power voltage, and the second power voltage may have a relatively lower voltage level with respect to the first power voltage. The power supply source 50 may supply a gate-on voltage and a gate-off voltage to the scan driver 20.

The look-up table 60 stores compensation data CD for compensating the digital video data DATA. The look-up table 60 outputs the compensation data CD to the digital data compensator 70. The compensation data CD are data for compensating the digital video data DATA.

The digital data compensator 70 receives the digital video data DATA input from a host system, and receives the compensation data CD input from the look-up table 60. The digital data compensator 70 compensates and outputs the digital video data DATA, using the compensation data CD. For example, the digital data compensator 70 may compensate the digital video data DATA by performing an operation of adding or subtracting the compensation data CD to or from the digital video data DATA. The digital data compensator 70 outputs the compensated digital video data DATA to the timing controller 40.

As described above, the organic light emitting display according to this embodiment performs an operation of adding or subtracting the compensation data CD to or from the digital video data DATA to solve a problem where the luminance of the pixels is different from that originally intended due to, for example, a fabrication process variation of the organic light emitting display. According to an embodiment, a calculation method of the compensation data CD is performed to allow the luminance of the pixels due to the fabrication process variation of the organic light emitting display to correspond to that originally intended. Hereinafter, a compensation data calculation method according to an embodiment of the present invention will be described in detail with reference to FIGS. 3 to 6.

Figure 3:
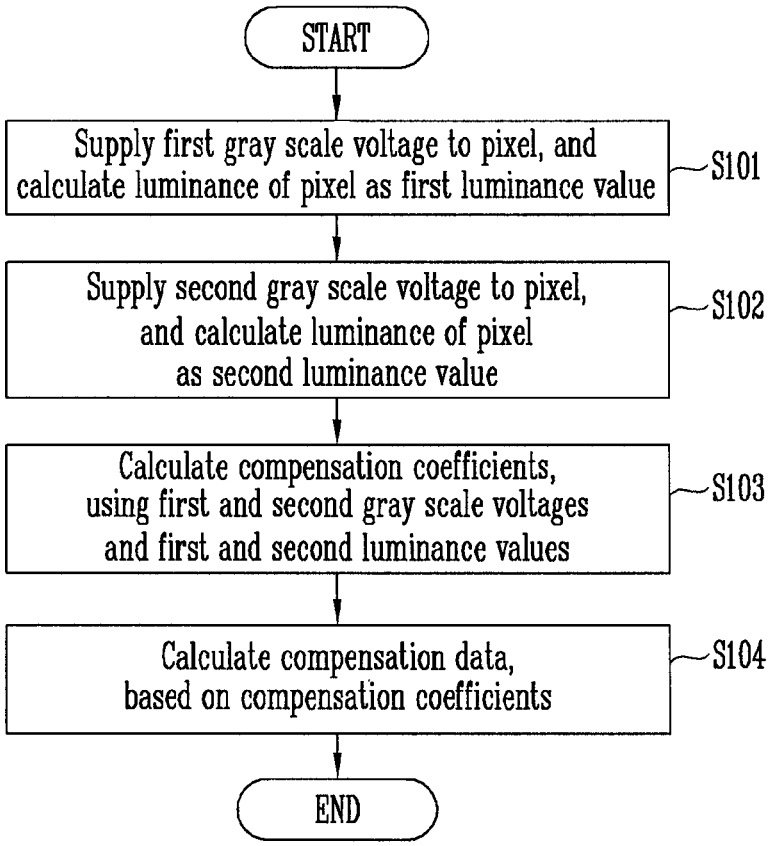
FIG. 3 is a flowchart illustrating a compensation data calculation method according to an embodiment of the present invention.
Figure 4:
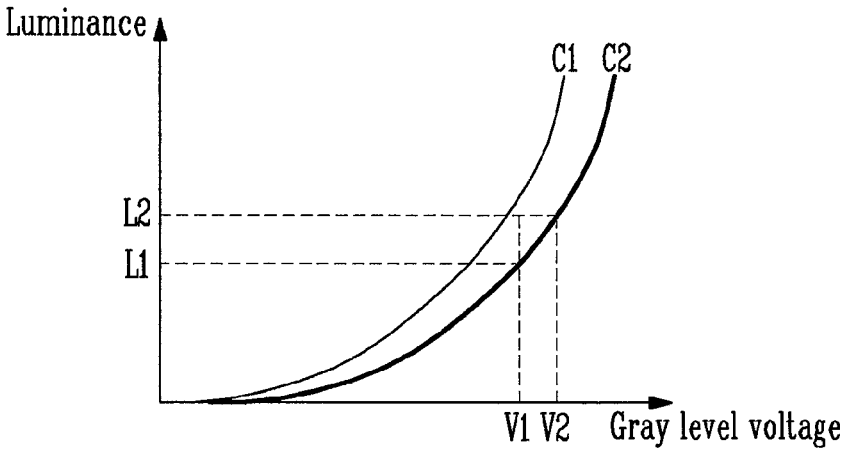
FIG. 4 is a graph illustrating an example of luminance of a pixel, based on a gray scale voltage supplied to the pixel.

FIG. 3 is a flowchart illustrating a compensation data calculation method according to an embodiment of the present invention. FIG. 4 is a graph illustrating an example of luminance of a pixel, based on a gray scale voltage (e.g., a gray level voltage) supplied to the pixel. Hereinafter, a compensation data calculation method according to this embodiment will be described in detail with reference to FIGS. 1 to 4. The compensation data calculation method according to this embodiment includes first to fourth steps S101 to S104.

First, in the first step S101, digital video data DATA corresponding to first gray scale data are supplied to the organic light emitting display. In this case, the timing controller 40 outputs, to the data driver 30, the digital video data DATA corresponding to the first gray scale data. The data driver 30 converts the first gray scale data into a first gray scale voltage V1 and supplies the first gray scale voltage V1 to the data lines D1 to Dm. Thus, the first gray scale voltage V1 is supplied to the pixel P of the display panel 10. In the first step S101, a luminance of the pixel P when the first gray scale voltage V1 is supplied to the pixel P of the display panel 10 is measured. The luminance of the pixel P when the first gray scale voltage V1 is supplied to the pixel P of the display panel 10 is calculated as a first luminance value L1 (S101).

Second, in the second step S102, digital video data DATA corresponding to second gray scale data are supplied to the organic light emitting display. In this case, the timing controller 40 outputs, to the data driver 30, the digital video data DATA corresponding to the second gray scale data. The data driver 30 converts the second gray scale data into a second gray scale voltage V2 and supplies the second gray scale voltage V2 to the data lines D1 to Dm. Thus, the second gray scale voltage V2 is supplied to the pixel P of the display panel 10. In the second step S102, a luminance of the pixel P when the second gray scale voltage V2 is supplied to the pixel P of the display panel 10 is measured. The luminance of the pixel P when the second gray scale voltage V2 is supplied to the pixel P of the display panel 10 is calculated as a second luminance value L2 (S102).

Third, in the third step S103, compensation coefficients are calculated using the first and second gray scale voltages V1 and V2 and the first and second luminance values L1 and L2. Specifically, in the third step S103, the compensation coefficients may be calculated using equations defined by the first and second gray scale voltages V1 and V2 and the first and second luminance values L1 and L2. Hereinafter, the compensation coefficients will be described in detail with reference to FIG. 4.

FIG. 4 shows a graph of luminance L of the pixel P, based on a gray scale voltage supplied to the pixel P. The x-axis shown in FIG. 4 indicates a gray scale voltage supplied to the pixel P, and the y-axis shown in FIG. 4 indicates a luminance of the pixel P. In FIG. 4, a first luminance curve C1 corresponds to an ideal luminance curve, and a second luminance curve C2 corresponds to a luminance curve distorted due to a fabrication process variation. In this case, the luminance L of the pixel P according to the second luminance curve C2 distorted due to the fabrication process variation may be defined as shown in Equation 1.

$$L=\alpha\times(Vd-\beta)^2 \qquad \text{Equation 1}$$

In Equation 1, α denotes an emission efficiency distribution of the organic light emitting diode OLED of the pixel P due to the fabrication process variation, β denotes a threshold voltage distribution of the diving transistor DT of the pixel P due to the fabrication process variation, Vd denotes a gray scale voltage supplied to the pixel P, and L denotes a luminance of the organic light emitting diode OLED of the pixel P. Here, α is defined as a first compensation coefficient, and β is defined as a second compensation coefficient.

Therefore, when the first gray scale voltage V1 is supplied to the pixel P as shown in FIG. 4, the first luminance value L1 that is a luminance of the pixel P may be defined as shown in Equation 2.

$$L1=\alpha\times(V1-\beta)^2 \qquad \text{Equation 2}$$

When the second gray scale voltage V2 is supplied to the pixel P as shown in FIG. 4, the second luminance value L2 that is a luminance of the pixel P may be defined as shown in Equation 3.

$$L2=\beta\times(V2-\beta)^2 \qquad \text{Equation 3}$$

Meanwhile, Equation 4 may be calculated by extracting the square root of a value obtained by dividing Equation 3 into Equation 2.

$$\Gamma=\sqrt{\frac{L2}{L1}}=\frac{V2-\beta}{V1-\beta} \qquad \text{Equation 4}$$

Equation 4 is rearranged to obtain Equation 5.

$$\beta=\frac{(\Gamma\times V1-V2)}{\Gamma-1} \qquad \text{Equation 5}$$

Equation 2 is rearranged to obtain Equation 6.

$$\alpha=\frac{L1}{(V1-\beta)^2} \qquad \text{Equation 6}$$

As a result, in the third step S103, the first and second compensation coefficients α and β can be calculated. Thus, the second luminance curve C2 that is a luminance curve distorted due to the fabrication process variation can be compensated as the first luminance curve C1 that is an ideal luminance curve by the first and second compensation coefficients α and β (S103).

Fourth, in the fourth step S104, compensation data CD are calculated based on the first and second compensation coefficients α and β. For example, in the fourth step S104, the compensation data CD are calculated so that the luminance of light that the pixel P emits matches the luminance of the first luminance curve C1, using the first and second compensation coefficients α and β when digital data obtained by adding or subtracting the compensation data CD to or from the digital video data DATA are supplied to the pixel P (S104).

Meanwhile, the compensation data calculation method according to this embodiment may be performed in a module process after a fabrication process of the organic light emitting display is completed. In this embodiment, the compensation data CD are calculated by the compensation data calculation method in the module process, and then stored in the look-up table 50.

As described above, in this embodiment, the compensation coefficients are calculated by supplying two gray scale data, e.g., the first gray scale data corresponding to the first gray scale voltage and the second gray scale data corresponding to the second gray scale voltage. As a result, in this embodiment, it is possible to reduce the calculation time of the compensation data.

Figure 5:
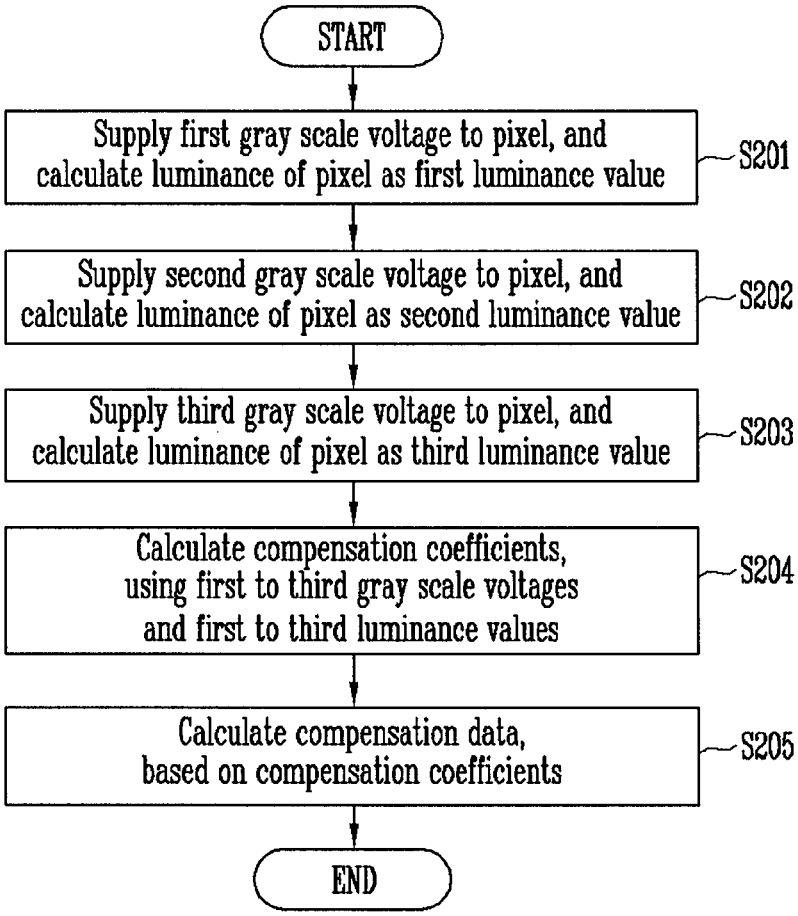
FIG. 5 is a flowchart illustrating a compensation data calculation method according to another embodiment of the present invention.
Figure 6:
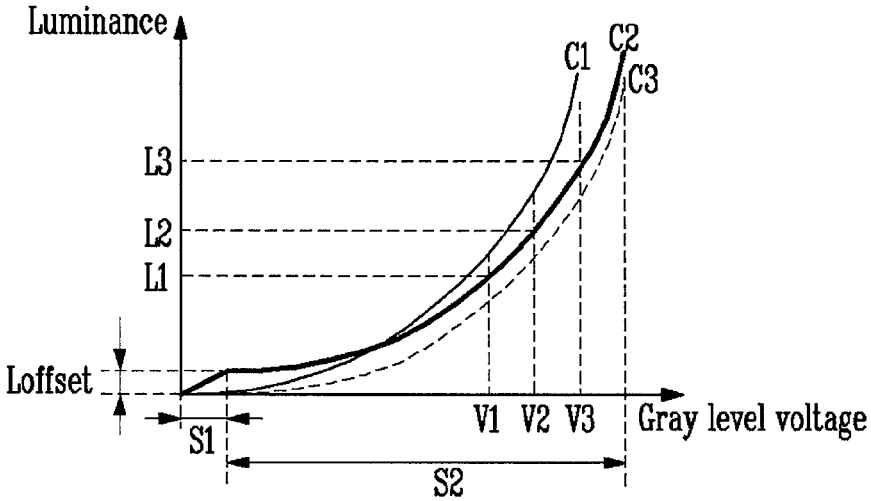
FIG. 6 is a graph illustrating another example of the luminance of the pixel, based on the gray scale voltage supplied to the pixel.

FIG. 5 is a flowchart illustrating a compensation data calculation method according to another embodiment of the present invention. FIG. 6 is a graph illustrating another example of the luminance of the pixel, based on the gray scale voltage supplied to the pixel. Hereinafter, the compensation data calculation method according to this embodiment will be described in detail with reference to FIGS. 1, 2, 5 and 6. The compensation data calculation method according to this embodiment includes first to fifth steps S201 to S205.

First, in the first step S201, digital video data DATA corresponding to first gray scale data are supplied to the organic light emitting display. In this case, the timing controller 40 outputs the digital video data DATA corresponding to the first gray scale data to the data driver 30. The data driver 30 converts the first gray scale data into a first gray scale voltage V1 and supplies the first gray scale voltage V1 to the data lines D1 to Dm. Thus, the first gray scale voltage V1 is supplied to the pixel P of the display panel 10. In the first step S201, a luminance of the pixel P when the first gray scale voltage V1 is supplied to the pixel P of the display panel 10 is measured. The measured luminance of the pixel P is calculated (e.g., determined) as a first luminance value L1 (S201).

Second, in the second step S202, digital video data DATA corresponding to second gray scale data are supplied to the organic light emitting display. In this case, the timing controller 40 outputs the digital video data DATA corresponding to the second gray scale data to the data driver 30. The data driver 30 converts the second gray scale data into a second gray scale voltage V2 and supplies the second gray scale voltage V2 to the data lines D1 to Dm. Thus, the second gray scale voltage V2 is supplied to the pixel P of the display panel 10. In the second step S202, a luminance of the pixel P when the second gray scale voltage V2 is supplied to the pixel P of the display panel 10 is measured. The measured luminance of the pixel P is calculated (e.g., determined) as a second luminance value L2 (S202).

Third, in the third step S203, digital video data DATA corresponding to third gray scale data are supplied to the organic light emitting display. In this case, the timing controller 40 outputs the digital video data DATA corresponding to the third gray scale data to the data driver 30. The data drive 30 converts the third gray scale data into a third gray scale voltage V3 and supplies the third gray scale voltage V3 to the data lines D1 to Dm. Thus, the third gray scale voltage V3 is supplied to the pixel P of the display panel 10. In the third step S203, a luminance of the pixel P when the third gray scale voltage V3 is supplied to the pixel P of the display panel 10 is measured. The measured luminance of the pixel P is calculated as a third luminance value L3 (S203).

Fourth, in the fourth step S204, compensation coefficients are calculated using the first to third gray scale voltages V1, V2 and V3 and the first to third luminance values L1, L2 and L3. For example, in the fourth step S204, the compensation coefficients may be calculated using equations defined by the first to third gray scale voltages V1, V2 and V3 and the first to third luminance values L1, L2 and L3. Hereinafter, the compensation coefficients will be described in detail with reference to FIG. 6.

FIG. 6 shows a graph of luminance L of the pixel P, based on a gray scale voltage supplied to the pixel P. The x-axis shown in FIG. 6 indicates a gray scale voltage supplied to the pixel P, and the y-axis shown in FIG. 6 indicates a luminance of the pixel P. In FIG. 6, a first luminance curve C1 corresponds to an ideal luminance curve, and a second luminance curve C2 corresponds to a luminance curve distorted due to a fabrication process variation. Meanwhile, unlike the second luminance curve C2 shown in FIG. 4, the second luminance curve C2 shown in FIG. 6 includes Loffset in a direction corresponding to the y-axis. The second luminance curve C2 may be divided into a first section S1 in which the curve ramps up to the Loffset and a second section S2 including the Loffset. When a third luminance curve C3 is calculated by subtracting the Loffset from the second section S2 of the second luminance curve C2, the luminance L of the pixel P according to the third luminance curve C3 may be defined as shown in Equation 3. That is, the second section S2 of the second luminance curve C2 may be compensated by compensating the third luminance curve C3, using Equation 7. However, the first section S1 of the second luminance curve C2 is not compensated using Equation 7. Therefore, the second section S2 of the second luminance curve V2 may be compensated by a dithering method.

$$L=\alpha\times(Vd-\beta)^2+\gamma \qquad \text{Equation 7}$$

In Equation 7, α denotes an emission efficiency distribution of the organic light emitting diode OLED of the pixel P due to the fabrication process variation, β denotes a threshold voltage distribution of the driving transistor DT of the pixel P due to the fabrication process variation, γ denotes Loffset, Vd denotes a gray scale voltage supplied to the pixel P, and L denotes a luminance of the organic light emitting diode OLED of the pixel P. Here, α is defined as a first compensation coefficient, β is defined as a second compensation coefficient, and γ is defined as a third compensation coefficient.

Therefore, when the first gray scale voltage V1 is supplied to the pixel P as shown in FIG. 6, the first luminance value L1 that is a luminance of the pixel P may be defined as shown in Equation 8.

$$L1=\alpha\times(V1-\beta)^2+\gamma \qquad \text{Equation 8}$$

When the second gray scale voltage V2 is supplied to the pixel P as shown in FIG. 6, the second luminance value L2 that is a luminance of the pixel P may be defined as shown in Equation 9.

$$L2=\alpha\times(V2-\beta)^2+\gamma \quad \text{Equation 9}$$

When the third gray scale voltage V3 is supplied to the pixel P as shown in FIG. 6, the third luminance value L3 that is a luminance of the pixel P may be defined as shown in Equation 10.

$$L3=\alpha\times(V3-\beta)^2+\gamma \quad \text{Equation 10}$$

Meanwhile, Equation 11 may be calculated by subtracting Equation 9 from Equation 10.

$$L3-L2=\alpha\times[(V3-\beta)^2-(V2-\beta)^2]=\alpha(V3+V2-2\beta)\times(V3-V2) \quad \text{Equation 11}$$

In addition, Equation 12 may be calculated by subtracting Equation 8 from Equation 9.

$$L2-L1=\alpha\times[(V2-\beta)^2-(V1-\beta)^2]=\alpha(V2+V1-2\beta)\times(V2-V1) \quad \text{Equation 12}$$

Meanwhile, when the difference V3−V2 between the third and second gray scale voltages V3 and V2 is equal to the difference V2−V1 between the second and first gray scale voltages V2 and V1, Equation 13 may be calculated by dividing Equation 12 into Equation 11.

$$\Gamma=\frac{L3-L2}{L2-L1}=\frac{V3+V2-2\beta}{V2+V1-2\beta} \quad \text{Equation 13}$$

Equation 13 is rearranged to obtain Equation 14.

$$\beta=\frac{\Gamma\times(V1+V2)-(V2+V3)}{2(\Gamma-1)} \quad \text{Equation 14}$$

Equation 11 is rearranged to obtain Equation 15.

$$\alpha=\frac{L3-L2}{(V3+V2-2\beta)\times(V3-V2)} \quad \text{Equation 15}$$

Equation 8 is rearranged to obtain Equation 16.

$$\gamma=L1-\alpha(V1-\beta)^2 \quad \text{Equation 16}$$

As a result, in the fourth step S204, the first to third compensation coefficients α, β and γ can be calculated. Thus, the third luminance curve C3 can be compensated as the first luminance curve C1 that is an ideal luminance curve by the first to third compensation coefficients α, β and γ (S204).

Fifth, in the fifth step S205, compensation data CD are calculated based on the first to third compensation coefficients α, β and γ. For example, in the fifth step S205, the compensation data CD are calculated so that the luminance of light that the pixel P emits matches the luminance of the first luminance curve C1, using the first to third compensation coefficients α, β and γ when digital data obtained by adding or subtracting the compensation data CD to or from the digital video data DATA are supplied, (S205).

Meanwhile, the compensation data calculation method according to this embodiment may be performed in a module process after a fabrication process of the organic light emitting display is completed. In this embodiment, the compensation data CD are calculated by the compensation data calculation method in the module process, and then stored in the look-up table 50.

As described above, in this embodiment, the compensation coefficients are calculated by supplying three gray scale data, e.g., the first gray scale data corresponding to the first gray scale voltage, the second gray scale data corresponding to the second gray scale voltage, and the third gray scale data corresponding to the third gray scale voltage. As a result, in this embodiment, it is possible to reduce the calculation time of the compensation data.

In some embodiments, when the luminance curve distorted due to the fabrication process variation includes a predetermined offset section, the offset section compensated by the dithering method, and the other section except the offset section is compensated using the equations defined by the first to third gray scale voltages and the first to third luminance values. As a result, in some embodiments, it is possible to improve the calculation accuracy of the compensation data.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims and their equivalents.

What is claimed is:

1. A method for calculating compensation data, the method comprising:

determining a first luminance value by supplying a first gray scale voltage to pixels and measuring a luminance;

determining a second luminance value by supplying a second gray scale voltage to the pixels and measuring a luminance;

calculating compensation coefficients utilizing the first and second gray scale voltages and the first and second luminance values; and calculating compensation data based on the compensation coefficients.

2. The method of claim 1, wherein the calculating the compensation coefficients comprises using equations including the first and second gray scale voltages and the first and second luminance values.

3. The method of claim 2, wherein, in the calculating the compensation coefficients, when the first gray scale voltage is V1, the second gray scale voltage is V2, the first luminance value is L1, the second luminance value is L2, a first compensation coefficient of the compensation coefficients is α, and a second compensation coefficient of the compensation coefficients is β, the first and second compensation coefficients are calculated by $$\alpha=\frac{L1}{(V1-\beta)^2},$$

-continued $$\beta = \frac{(\Gamma \times V1 - V2)}{\Gamma - 1}$$

and $$\Gamma = \sqrt{\frac{L2}{L1}}.$$

4. The method of claim 1, further comprising determining a third luminance value by supplying a third gray scale voltage to the pixels and measuring the luminance, wherein, the calculating the compensation coefficients further comprises utilizing the third gray scale voltage and the third luminance value.

5. The method of claim 4, wherein the calculating the compensation coefficients comprises utilizing equations including the first to third gray scale voltages and the first to third luminance values.

6. The method of claim 5, wherein, in the calculating the compensation coefficients, when the first gray scale voltage is V1, the second gray scale voltage is V2, the third gray scale voltage is V3, the first luminance value is L1, the second luminance value is L2, the third luminance value is L3, a first compensation coefficient of the compensation coefficients is α, a second compensation coefficient of the compensation coefficients is β, and a third compensation coefficient of the compensation coefficients is γ, the first to third compensation coefficients are calculated by $$\alpha = \frac{L3 - L2}{(V3 + V2 - 2\beta) \times (V3 - V2)},$$

$$\beta = \frac{\Gamma \times (V1 + V2) - (V2 + V3)}{2(\Gamma - 1)},$$

$$\gamma = L1 - \alpha \times (V1 - \beta)^2, \text{ and } \Gamma = \frac{L3 - L2}{L2 - L1}.$$

7. The method of claim 5, wherein a difference between the third and second gray scale voltages is substantially equal to the difference between the second and first gray scale voltages.

8. An organic light emitting display, comprising:

a display panel comprising data lines, scan lines, and pixels coupled to the data lines and the scan lines;

a scan driver configured to supply scan signals to the scan lines;

a data driver configured to convert digital video data into data voltages, and to supply the data voltages to the data lines, in synchronization with the scan signals;

a look-up table configured to store compensation data for compensating the digital video data; and a digital data compensator configured to compensate the digital video data utilizing the compensation data, wherein a first luminance value is determined by supplying a first gray scale voltage to the pixels and measuring a luminance, a second luminance value is determined by supplying a second gray scale voltage to the pixels and measuring a luminance, compensation coefficients are calculated utilizing the first and second gray scale voltages and the first and second luminance values, and the compensation data are calculated utilizing the compensation coefficients.

9. The organic light emitting display of claim 8, wherein the compensation coefficients are calculated using equations including the first and second gray scale voltages and the first and second luminance values.

10. The organic light emitting display of claim 9, wherein, when the first gray scale voltage is V1, the second gray scale voltage is V2, the first luminance value is L1, the second luminance value is L2, a first compensation coefficient of the compensation coefficients is α, and a second compensation coefficient of the compensation coefficients is β, the first and second compensation coefficients are calculated by $$\alpha = \frac{L1}{(V1 - \beta)^2},$$

$$\beta = \frac{(\Gamma \times V1 - V2)}{\Gamma - 1}$$

and $$\Gamma = \sqrt{\frac{L2}{L1}}.$$

11. The organic light emitting display of claim 8, wherein a third luminance value is determined by supplying a third gray scale voltage to the pixels and measuring a luminance, compensation coefficients are calculated using the third gray scale voltage and the third luminance value, and the compensation data are calculated based on the compensation coefficients.

12. The organic light emitting display of claim 11, wherein the compensation coefficients are calculated using equations including the first to third gray scale voltages and the first to third luminance values.

13. The organic light emitting display of claim 12, wherein, when the first gray scale voltage is V1, the second gray scale voltage is V2, the third gray scale voltage is V3, the first luminance value is L1, the second luminance value is L2, the third luminance value is L3, a first compensation coefficient of the compensation coefficients is α, a second compensation coefficient of the compensation coefficients is β, and a third compensation coefficient of the compensation coefficients is γ, the first to third compensation coefficients are calculated by $$\alpha = \frac{L3 - L2}{(V3 + V2 - 2\beta) \times (V3 - V2)},$$

$$\beta = \frac{\Gamma \times (V1 + V2) - (V2 + V3)}{2(\Gamma - 1)},$$

$$\gamma = L1 - \alpha \times (V1 - \beta)^2, \text{ and } \Gamma = \frac{L3 - L2}{L2 - L1}.$$

14. The organic light emitting display of claim 12, wherein a difference between the third and second gray scale voltages is substantially equal to the difference between the second and first gray scale voltages.

* * * * *